United States Patent [19]

Cacioni

[11] 4,353,230

[45] Oct. 12, 1982

[54] COMBINATION CONTROLLED FLUID PRESSURE ACTUATED DOOR LOCK

[76] Inventor: Renato Cacioni, Via Piccolpasso, 121, 06085 Perugia, Italy

[21] Appl. No.: 59,662

[22] Filed: Jul. 23, 1979

[30] Foreign Application Priority Data

Sep. 15, 1978 [IT] Italy ..... 43518 A/78
Jun. 22, 1979 [IT] Italy ..... 49505 A/79

[51] Int. Cl.[3] ..... E05B 37/12; E05B 51/02; E05B 63/14

[52] U.S. Cl. ..... 70/275; 70/263; 70/287; 70/317; 70/318; 70/DIG. 48; 137/552.5

[58] Field of Search ..... 70/DIG. 48, 312, 275, 70/263, 266, 286, 287, 318, 317, 175, 278; 137/552.5, 613

[56] References Cited

U.S. PATENT DOCUMENTS

| | | | |
|---|---|---|---|
| 787,575 | 4/1905 | Hofstatter | 70/286 X |
| 1,075,429 | 10/1913 | Mazuel | 70/175 UX |
| 1,085,058 | 1/1914 | Messick | 70/DIG. 48 X |
| 1,233,825 | 7/1917 | Wagner | 137/552.5 |
| 1,406,813 | 2/1922 | Bailly | 70/275 X |
| 1,657,650 | 1/1928 | Vrba | 70/318 X |
| 2,298,776 | 10/1942 | Rhein | 70/275 X |
| 3,473,354 | 10/1969 | Hutchins | 70/312 |
| 3,610,004 | 10/1971 | Neese | 70/DIG. 48 |
| 3,879,970 | 4/1975 | Salzman et al. | 70/275 |
| 4,104,896 | 8/1978 | Hahn | 70/318 X |
| 4,187,704 | 2/1980 | Ristic-Petrovic | 70/263 |

FOREIGN PATENT DOCUMENTS

| | | | |
|---|---|---|---|
| 2600293 | 7/1976 | Fed. Rep. of Germany | 70/312 |
| 787499 | 9/1935 | France | 70/318 |
| 56862 | 8/1944 | Netherlands | 70/286 |
| 928744 | 6/1963 | United Kingdom | 137/552.5 |

*Primary Examiner*—Roy D. Frazier
*Assistant Examiner*—Carl F. Pietruszka
*Attorney, Agent, or Firm*—McAulay, Fields, Fisher, Goldstein & Nissen

[57] ABSTRACT

A fluid-actuated locking device for the doors of dwellings or offices or for armored doors having a plurality of tubes for the flow of a fluid supplied from a reservoir, which fluid may either be pressurized to operate a lock or may flow back through the tubes after the release of the pressure so as to allow the locking of the door; a presettable combination is provided to predetermine whether fluid will flow through the tubes thus allowing operation of the lock to unlock the door, numbers or letters being provided and usable in the presettable combination; the fluid is subjected to pressure by a pump to effect withdrawal of pistons from the locking once the preset combination has been set to the preselected combination; the fluid is fed to the lock by a valved manifold which also controls the back flow of the fluid from the lock to the reservoir and works in association with the presettable combination to unlock or lock the door; and locking of the door is accomplished by the action of springs in the lock and unlocking the door is accomplished by the action of the pressure generated by the pumping in the appropriate tubes.

6 Claims, 12 Drawing Figures

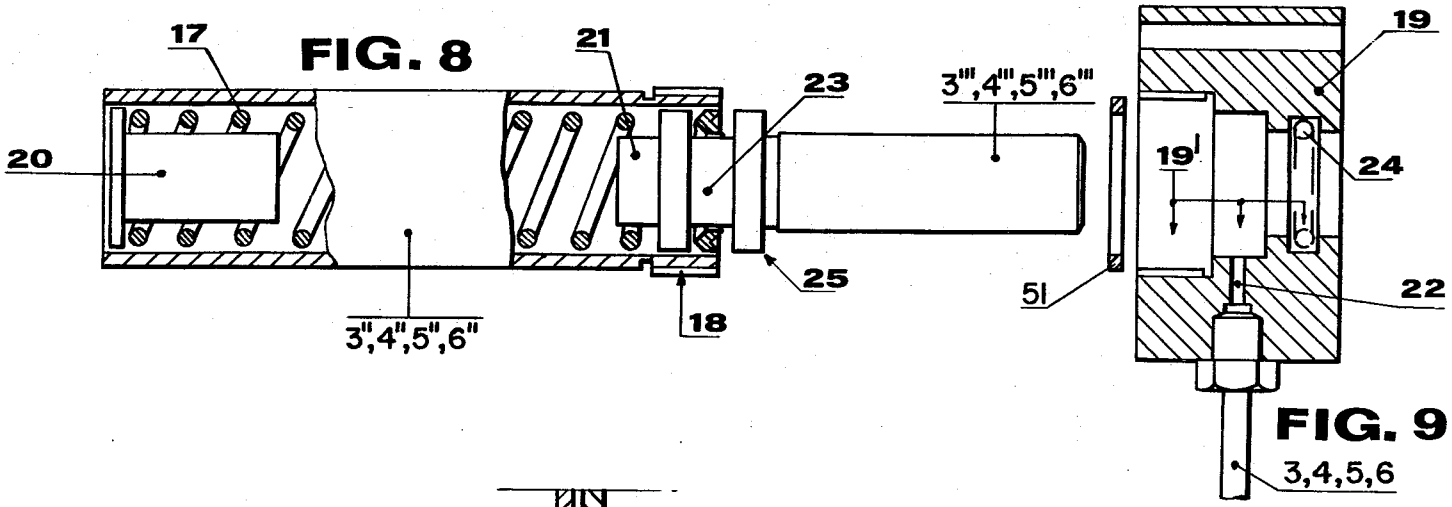
FIG. 9
FIG. 8
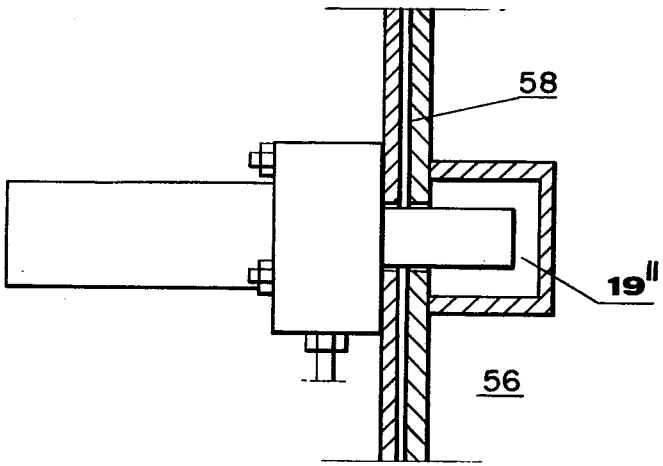
FIG. 10

COMBINATION CONTROLLED FLUID PRESSURE ACTUATED DOOR LOCK

BACKGROUND OF THE INVENTION

The present invention concerns a fluid-actuated locking device controlled by a combination for the doors of dwelling and offices and for armored doors.

It is well known that safety devices used until now for the doors of dwellings and offices comprise somewhat complicated mechanically operated combination locks (using letters or numbers). Also the safety devices for safes usually work mechanically, and the opening or locking of their doors is effected by means of a key.

Apart from the usual somewhat complicated locks, mechanically operated combination locks show many disadvantages. First of all, space is needed to install the entire device. Another disadvantage lies in the fact that the position of the locking zones of the door depends on the geometry of the device, and further, each locking zone needs separate operating means. Moreover, all the mechanical elements are subject to wear. Not least, with such mechanically operated devices it is possible for a thief to figure out the combination by probing for unavoidable noises, even if these are barely audible. Furthermore, in such devices the locking zones are all mechanically interconnected. If the thief gets control of one of these locking zones, he will control the others and thus the entire device. Finally, with regard to the locking and the opening of the door, a key is needed. Moreover, these disadvantages are associated with high investment costs.

It is therefore the aim of the present invention to provide a combination-controlled safety device for the doors of dwellings and offices which needs very little space for its installation in a door, is subject to a very low wear rate, is simple and economical, and whose operation is absolutely noiseless so that no information can be derived about the predetermined combination through probing for noises, and wherein the individual locking zones of the door are not dependent on geometrical factors and can therefore be installed in any area of the door, and wherein no key is needed for the opening and locking of said door.

SUMMARY OF THE INVENTION

The aim of the present invention is attained by a hydraulic-pneumatic device substantially comprising:

(a) a plurality of tubes for the flow of a fluid supplied from a reservoir, wherein the fluid may be pressurized for operation on locking means or may flow back through the tubes after the release of the pressure so as to allow the locking of the door;

(b) combination means which allow flow through the tubes when set in accordance with a predetermined letter (or number) combination, thus allowing operation on said locking means and consequently the unlocking of the door;

(c) pumping means which subjects the fluid to pressure to effect withdrawal of pistons from said locking means once all of said combination means are set to the predetermined combination;

(d) a valved manifold means for feeding the fluid to the locking means, and for also controlling the back flow of said fluid from the locking means to said reservoir, thereby allowing, in conjunction with the combination means, the unlocking or the locking of the door; and (e) locking means which lock the door by the action of their own springs and unlock the door by the action of the pressure generated by said pumping means in the appropriate tubes.

According to the main principle of the present invention, a locking device will not make use of a key for the operation thereof; the operation will take place solely through a pressure change and by the feeding of the liquid (or the gas) through the appropriate tubes.

BRIEF DESCRIPTION OF THE DRAWINGS

The invention is best explained with reference to the drawings, in which:

FIG. 8 shows a longitudinal section of the cylinder of the locking means of the present invention with the piston pushed out for engagement with the door frame;

FIG. 9 shows a front section of the sleeve which is to be screwed onto the cylinder of FIG. 8, and which is provided with an inlet aperture for the liquid;

FIG. 10 shows a schematic frontal partially sectioned view of the piston being engaged with the door frame;

DESCRIPTION OF THE PREFERRED EMBODIMENT

Figure 2:
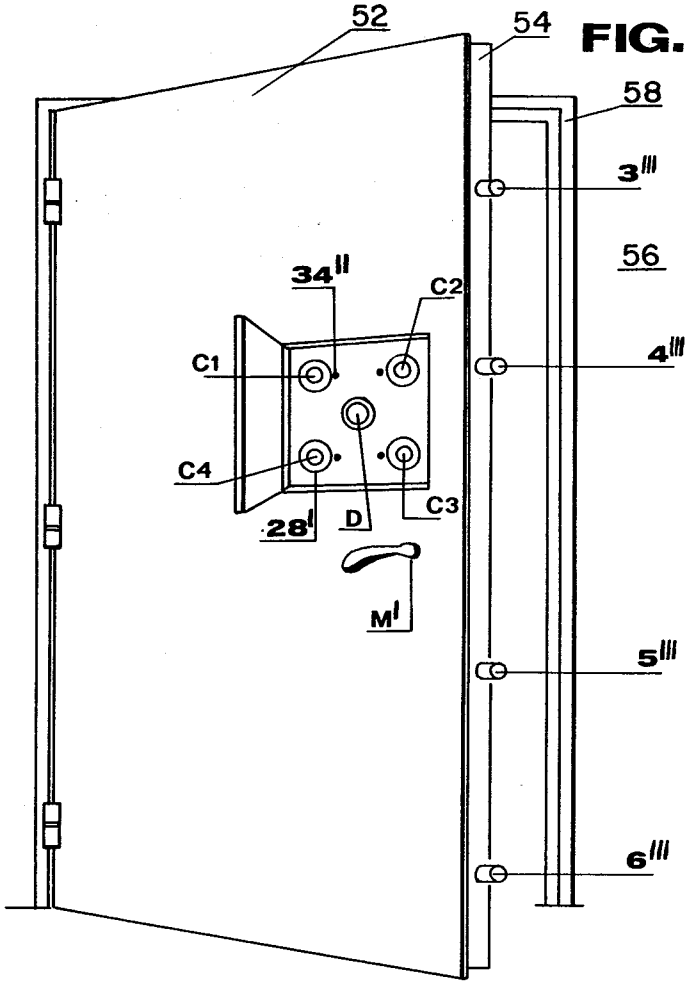
FIGS. 1 and 2 show perspective views of the front and the rear of a half-closed door provided with a locking device according to the present invention.
Figure 1:
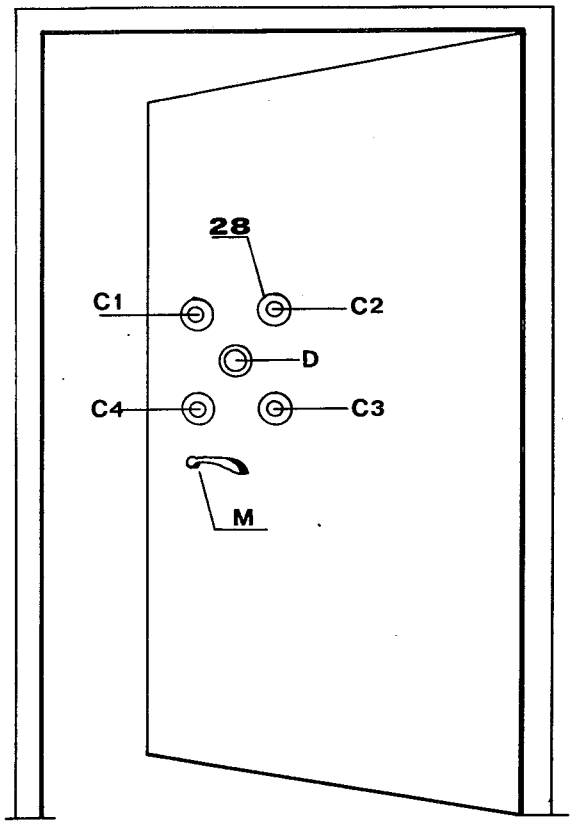

FIGS. 1 and 2 show the door 52, provided with the locking device according to the present invention, in its half-closed position from the inside and from the outside. The door comprises a steel frame 54 with a Dural-covering around its circumference, which effects a softer closing when the door is slammed and better air sealing thereafter.

The door covering may be made out of any kind of wood. Also a frame 58 installed in a wall 56 is made out of steel. In FIGS. 1 and 2 are shown door handles M and M', as well as the rotary knobs 28, 28' of combination devices C1, C2, C3, C4, each of which bear the twenty-one letters of the Latin alphabet. All of these elements can be operated from the inside as well as from the outside, as corresponding elements are functionally connected. In the inside of the door is provided a tin plate (not shown) on which the tubes of FIG. 3 and the pump gears actioned by handles M, M' are mounted.

Figure 3:
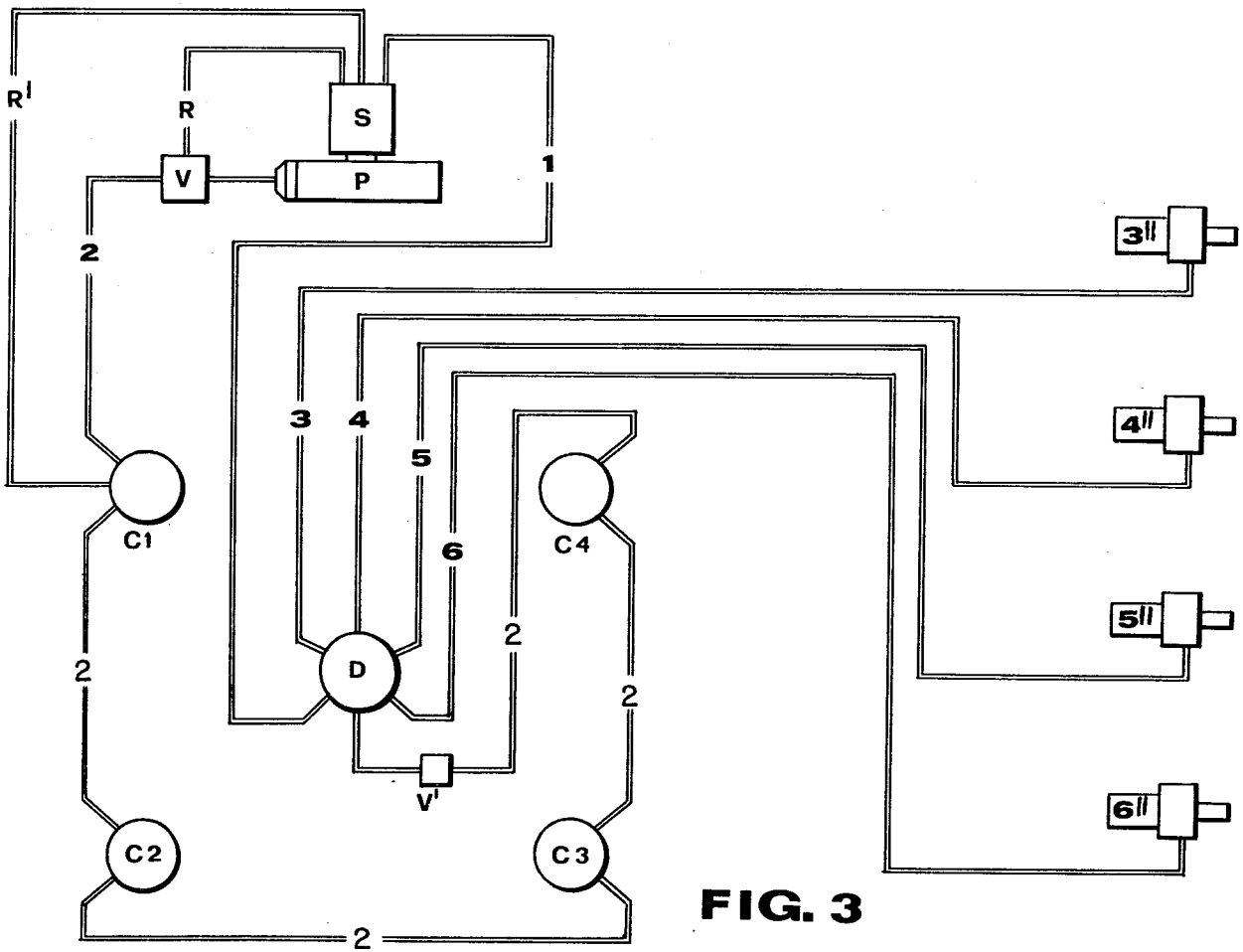
FIG. 3 shows a schematic view of the tube connections according to the present invention.

In FIG. 3 are shown schematically the reservoir S for the liquid (or the gas), the tubes 1, 2, 3, 4, 5, 6, and the pump P, which is described in more detail hereinbelow.

Figure 6:
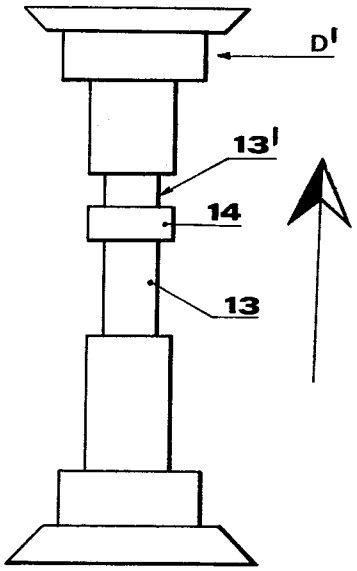
FIGS. 6 and 7 show a frontal view of the movable body of the manifold device in an extended and a retracted position.
Figure 5:
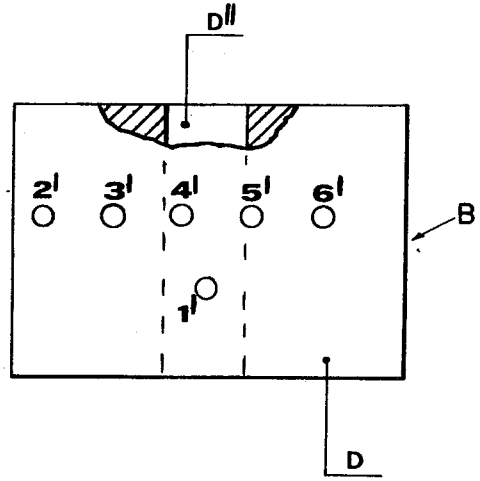
FIG. 5 shows the fixed body of the valved manifold device of the invention represented in a rolled out top view.
Figure 7:
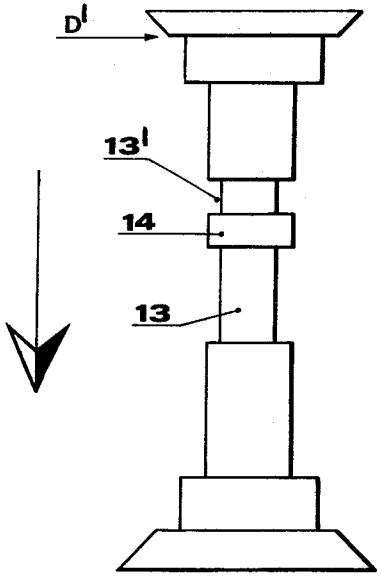

Tube 1 is shown connecting reservoir S directly to the valved manifold device D described in more detail in the discussion of FIGS. 5, 6 and 7. Tube or line 2 is shown serially connecting pump P to the four combination devices C1, C2, C3, C4. Finally, tubes 3, 4, 5, 6 are shown connecting the manifold device D directly to the four locking means 3'', 4'', 5'', 6'', 3''', 4''', 5''', 6''', which are described in more detail in the discussion relating to FIGS. 8, 9 and 10.

FIGS. 5, 6 and 7 show a sleeve-like fixed body B of the valved manifold device D (FIG. 5), as well as the movable body D' of the same in an extended and a retracted position (FIGS. 6 and 7).

The sleeve-like fixed body B of manifold device D is shown in a rolled out view (it is fixed to the unshown tin plate). The body B is positioned in the middle of the four combination devices C1, C2, C3, C4, as shown in FIGS. 1, 2, and 3. On the surface as rolled out, fixed body B has holes 1', 2', 3', 4', 5', and 6' disposed on two planes vertical to the plane of the rolled out fixed body (i.e., to the axis of the sleeve) the planes being at a short parallel distance from one another. Hole 1' provided in the first of these planes connects manifold device D to reservoir S; hole 2', formed together with holes 3', 4', 5', and 6' in the same second plane, connects manifold device D to pump P through combination devices C1, C2, C3, C4. Holes 3', 4', 5', 6' connect the manifold device D with the four locking means (3'', 4'', 5'', 6''; 3''', 4''', 5''', 6'''). In the middle of the sleeve-like fixed body B an aperture D'' is provided, wherein movable body D' of the manifold device D may be moved to a determined distance along its axis.

The six holes 1', 2', 3', 4', 5', 6', are connected with the aperture D'' of the manifold device.

In FIGS. 6 and 7 is shown the movable body D' of the manifold device D. FIG. 6 shows how groove 13 provided in movable body D' is positioned so as to be in correspondence with hole 1' as well as with holes 2', 3', 4', 5', 6', so that the liquid may flow through all the six holes at the same time. FIG. 7 illustrates how section 14 of movable body D', not provided with a groove, blocks hole 1' and therefore the flow through tube 1 towards reservoir S. With the same position of body D', groove 13' provided therein allows the flow through holes 2', 3', 4', 5', 6'.

According to the present invention, six (or more) tubes 1, 2, 3, 4, 5, 6 are provided, all leading to the valved manifold device D. Said device substantially comprises a sleeve-like body B fixed in the door 52 and a body D' movable in a longitudinal direction through a central aperture D'' provided in fixed body B. The sleeve-like fixed body B has on its outer wall a total of six transverse holes 1', 2', 3', 4', 5', 6' connecting said outer wall with the inside of central aperture D'' wherein the movable body D' may be moved. The axis of one of the six holes 1', which is separated from the other five, although oriented in the same direction, is in a plane which is perpendicular to the axis of the sleeve-like body B. The axes of the other five holes are in another plane, placed at a short parallel distance from the first plane. The movable body D' of the manifold device D can be slid inside the fixed body B in a longitudinal direction thereto. It is provided with a groove 13 whose width is equal to the distance between the two planes, so that with a corresponding setting of the movable body D', the liquid coming from all of the six holes finds a free passage.

The movable body D' has furthermore, beyond said first groove 13, a part 14 not provided with a groove, as well as a second narrower groove 13'. When setting movable body D' in the second position, the part 14 of said body not provided with a groove blocks the hole 1', and thus prevents flow through the tube 1. At the same time the narrower groove 13' gets into contact with the other five holes disposed in the second plane, and thus allows flow through the corresponding tubes connected thereto.

Therefore, the main function of the manifold device D is to allow two different working positions. The first working position permits flow of the fluid through all the six holes provided therein. In the second working position, one of the holes is blocked and flow is allowed only through the other five holes which are placed in the same area. The first hole 1', is connected to the first tube 1, which leads directly to the reservoir S.

The second tube line 2 originates from the pump P which is placed immediately below the reservoir S and terminates at the manifold device D. This second line connects in series four (or more) combination devices C1, C2, C3, C4, which are described in detail below.

Figure 4:
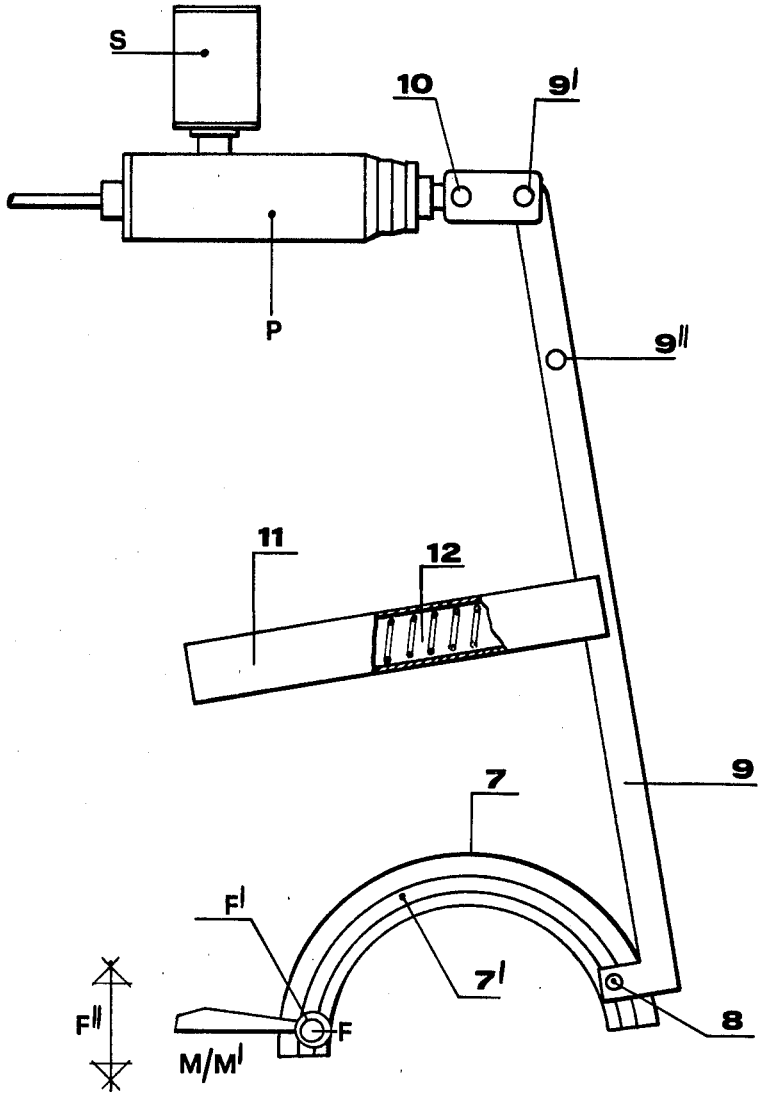
FIG. 4 shows a schematic view of the pump gear according to the present invention.

FIG. 4 shows schematically the pump gear being actioned by door handles M, M'. Both handles M, M' are operable by means of a common bolt F, pivoting about axis F'; inner handle M' is in turn connected to a cam 7.

Both door handles may be moved, according to arrow F'', upwards as well as downwards. Semicircular cam 7 has, throughout its length, an oblong groove 7', wherein a bolt 8 integral with one end of lever 9 may slide. Lever 9 is pivotably mounted at 9'', and is articulated at 9' to piston 10 of the pump P. Lever 9 exerts a pressure on one end of a spring 12, inserted in a tubular jacket 11, the spring force being adjustable by means of a screw (not shown). The tubular jacket 11 is affixed near its center to the aforesaid tin plate. The spring force serves to support during pumping the hand-actioning of door handles M, M' against the increasing liquid pressure.

The flow through tube 2 is effected by means of the pump gear of FIG. 4 operated by the door handle M, M'. The pump gear is affixed, as are the pump P, the reservoir S, the manifold device D, and the combination devices C1, C2, C3, C4, on a tin plate (not shown) installed inside the door 42. The door has an inner and an outer handle M, M' tightly connected by means of a common transverse bolt F. Both handles are furthermore tightly connected to a semicircular cam 7 mounted on the inner handle M'. The cam has a central oblong groove 7' extending over its entire length. In the oblong groove 7' is a sliding bolt 8 which is integral with a one-arm lever 9 at one end thereof. The lever 9 has near its upper end a pivot 9'' (affixed to the tin plate) and joined at its outer end to the piston 10 of pump P. A tubular jacket 11, which houses a coil spring 12, is affixed to the one-arm lever at about its middle and nearly at a right angle thereto. To effect pumping, one of the door handles M, M' is moved up and down, which causes the one-arm lever 9 to push during the suction stroke against spring 12. On the other hand, during the compression stroke, lever 9 is acted upon by the force of the previously compressed spring 12. The tubular jacket 11 is affixed at about its middle to the tin plate. The coil spring 12 may be adjusted by means of a screw (not shown) to any desired compressive force. The function of the coil spring is to reduce the pumping force which needs to be exerted by means of one of the door handles for generating the required pressure in the corresponding tubes. The build-up of this pressure occurs as mentioned before by alternately pumping one of the door handles M, M' upwards and downwards two or three times. In this case the bolt 8 that is integral with the one-arm lever 9 will enter the oblong groove 7' of the cam 7 and act on the pump P with suction or compression strokes.

The other tubes, i.e., in this case, tubes 3, 4, 5, 6 connect the other four holes 3', 4', 5', 6' disposed on the same second plane, with the corresponding locking means 3'', 4'', 5'', 6''. These locking means may be installed without any difficulty in any number and in any place along the edge of the door. Each one of these means comprises a cylinder with an incorporated movable piston 3''', 4''', 5''', 6''', and will be described in more detail below. Obviously, each locking means is connected through its own tube 3, 4, 5, 6 to the manifold device D.

The second tube, i.e., the pump tube 2, leads from the pump P, through a plurality of series-connected letter or number combination devices C1, C2, C3, C4, towards the manifold device D. In the described embodiment four combination devices are provided. As all of the four combination devices have the same structure, only one of them will be described in the subsequent discussion.

True safety is guaranteed by means of these combination devices, because only at a correct positioning of each combination device can the liquid flow through the entire tubing sequence. This is the case only when each combination device is set according to one predetermined letter or number. Only in this case may the liquid, put under pressure by the pumping action, flow from the pump through all combination devices towards the manifold device D and from there towards each locking device 3'', 4'', 5'', 6''. Under this pressure the pistons 3''', 4''', 5''', 6''' of the corresponding locking means are pushed into their respective cylinders and the door 12 may be opened.

FIG. 8 shows one of the four locking means comprising a cylinder 3'', 4'', 5'', 6'' and a piston 3''', 4''', 5''', 6''' movable therein. All of the locking means show the same structure, and the operation is the same for all.

Cylinder 3'', 4'', 5'', 6'' has, at one of its ends, a threading 18 on which a sleeve 19 is screwed, which is described in more detail in the text relating to FIG. 9. In said cylinder a coil spring 17 mounted on a bolt 20 is provided, one end of said spring striking against the head of bolt 20 and being of such dimensions as to exert considerable pressure on the end 21 of piston 3''', 4''', 5''', 6'''. By means of this spring pressure, piston 3''', 4''', 5''', 6''' is pushed out through sleeve 19 and enters into the corresponding cavity 19'' of the door frame installed in the wall (FIG. 10). Thus the door remains locked.

As can be seen from FIG. 9, sleeve 19 screwed onto the threads 18 of cylinder 3'', 4'', 5'', 6'' is provided with a transverse hole 22 connecting the outer wall of the sleeve to its central aperture 19'. Piston 3''', 4''', 5''', 6''' may be moved in aperture 19'. Central aperture 19' has a steped diameter. Hole 22 is connected to tubing 3, 4, 5, 6. Sleeve 19 is thereby connected to the manifold device D. Groove 23 of the piston is adapted to receive a sealing ring (not shown) which provides sealing between piston 3''', 4''', 5''', 6''', and the inside of cylinder 3'', 4'', 5'', 6''. Wall 25 of groove 23 provides a stop against the shoulder of the first step of central hole 19'. The diameter of wall 25 is therefore larger than that of piston 3''', 4''', 5''', 6''', as indicated in FIG. 8. The outer end of sleeve 19 is sealed off from the outside by means of a sealing ring 24. The liquid penetrating under pressure through hole 22, is thus confined in the space between sealing ring 24 and the sealng ring contained within groove 23, and exerts pressure on wall 25 against the force of spring 17, thereby pushing piston 3''', 4''', 5''', 6''' into cylinder 3'', 4'', 5'', 6''. The door can thus be opened.

FIG. 10 shows the normal outward position of piston 3''', 4''', 5''', 6'''; in this case, the piston is engaged within cavity 19'' of the door frame 58 installed in the wall 56. When the piston is in this position, the door is locked. A plurality of locking means are provided and placed anywhere at the circumference of door 52 and substantially comprise a cylinder 3'', 4'', 5'', 6'' (FIG. 8) containing a coil expansion spring 17. Under the action of the spring a piston 3''', 4''', 5''', 6''', may be driven outward (door closed). Under the action of the pressure of the liquid the same piston is returned inward (door unlocked). The coil expansion spring 17 is mounted on a bolt 20 against whose head one of the spring ends pushes. The length of bolt 20 is determined in such a way that its end serves as a stop for the piston movable inside the cylinder. The end of the cylinder turned towards the outside of the door frame 54 is provided with threads 18 whereon a sleeve 19 is screwed into which the piston may be driven two thirds of its length. At the inward end of the piston an annular groove 23 is provided with an appropriate seal 50. The sleeve has a central aperture 19' provided with a stepped diameter whose larger portion is near the threaded end of the cylinder. The shoulder of this portion is provided with a sealing ring 51 serving at the same time as a seal for the end of the cylinder and as a stop for the outward wall 25 of the groove 23 of the piston. The central portion of aperture 19' has a transverse passage 22 connecting aperture 19' with the outside of sleeve 19.

To this passage 22 is joined a corresponding tube which is in turn connected to the manifold device D and through which the liquid flows under pressure. The smallest part of the stepped diameters of aperture 19' has a diameter equal to the diameter of the piston up to the usual tolerances. A sealing ring 24 is provided at its base, i.e., at its outward end. The seal 50 provided in groove 23 and the last mentioned sealing ring 24 serve to prevent the liquid (or gas) from flowing out, outwardly from the sleeve or inwardly into the cylinder. The pressurized fluid exerts pressure on wall 25 and thus causes the inward movement of the piston and the unlocking of the door.

If the door has to be locked again, it is sufficient to shift the movable body D' of the manifold device D again into the position in which all of the holes 1', 2', 3', 4', 5', 6', are brought into interconnection. The pressurized liquid will then flow back through tube 1 from the manifold device D to the reservoir S. The pistons are thereby freed from the pressure of the fluid, are pushed out of their cylinders under the action of their springs, and the door is locked again.

Figure 11:
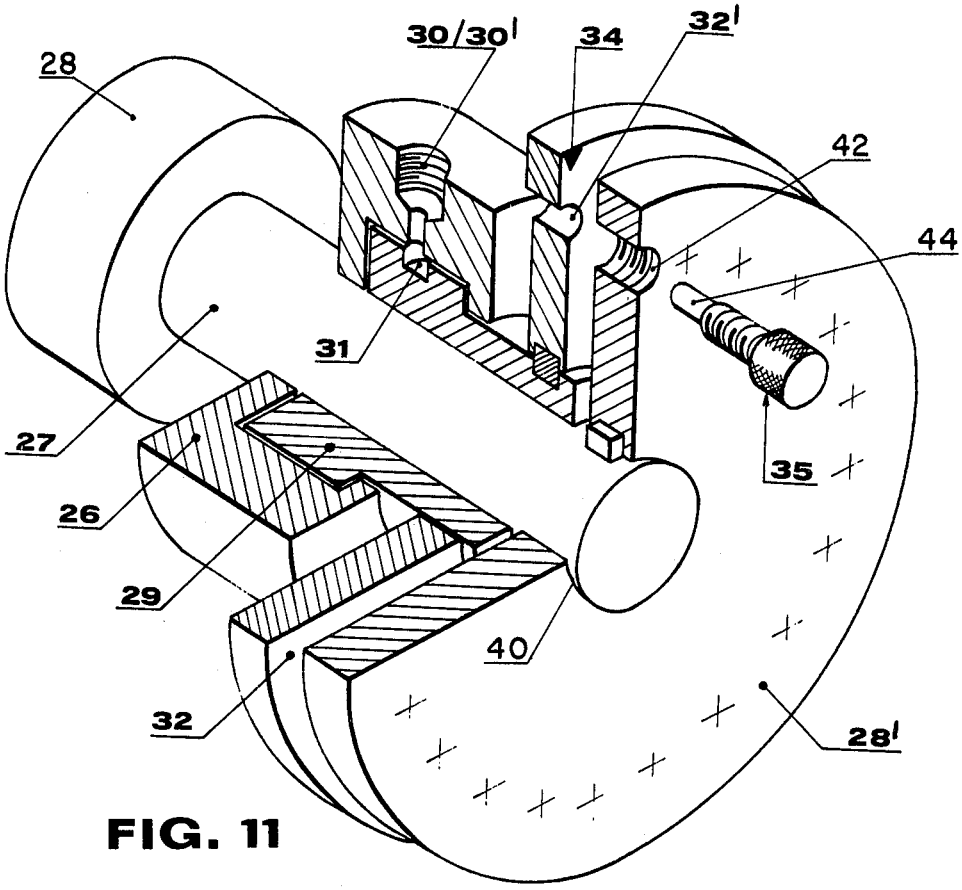
FIG. 11 shows a perspective partially sectioned view of the single elements disposed for flow in a combination device.

In FIG. 3 the combination devices C1, C2, C3, C4 are disposed at the four corners of a square. In the middle of the square is provided the manifold device D. As shown in FIG. 11, each combination device includes a central sleeve 26, its outer portion comprising two side-by-side bores 30, 30'. Line 2 originating from pump P is connected serially with inlet bore 30 of each device C1, C2,

C3, C4; the continuation of line 2 is connected to the respective outlet bore 30' and finally reaches hole 2' of manifold device D. The combination devices C1, C2, C3, C4 are oriented in such a way that the corresponding inlet and outlet bores 30, 30' are facing one another. All combination devices show the same structure; therefore, in the following discussion only one combination device will be described with reference to FIG. 11.

As can be seen in FIG. 11, the combination device comprises a sleeve 26 having a central aperture 40 in which is placed a shaft 27 which can freely rotate. Rotary knobs or disk-like members 28, 28', bearing the twenty-one letters of the Latin alphabet or other such indicia, are affixed to the end of shaft 27 inside and outside of the door. On shaft 27 is seated a freely rotatable sleeve or lining member 29 made out of bronze or other appropriate material. In the outer wall of sleeve or lining member 29 is provided a small groove 31 which can be brought—as will be described in more detail hereinbelow—in accordance with a determined setting thereof, into correspondence with holes 30, 30'. On the circumferential portion of rotary knob or disk-like member 28' are formed as many tapholes 52 as there are letters borne by the knob or member. A disk 32 is affixed to sleeve 29, and the diameter of said disk is somewhat bigger than the diameter of rotary knob or member 28'. A hole 32' is provided in the outer portion of disk 32 in such a way that it can always be made coaxial with a taphole corresponding to any letter by turning the rotary knob 28, 28'. A marking 34 is provided on the edge of disk 32 corresponding to hole 32'. A knurled-headed screw 35 may be screwed, following selection of the desired letter, into its respective taphole 42. As can be seen from FIG. 11, the section of the screw shaft towards the screw head is threaded. If screw 35 is screwed into the taphole 42, the smooth section 44 of the screw enters hole 32' of disk 32. Thus rotary knobs or members 28, 28', disk 32, and sleeve 29 become an operational unity with shaft 27.

Figure 12:
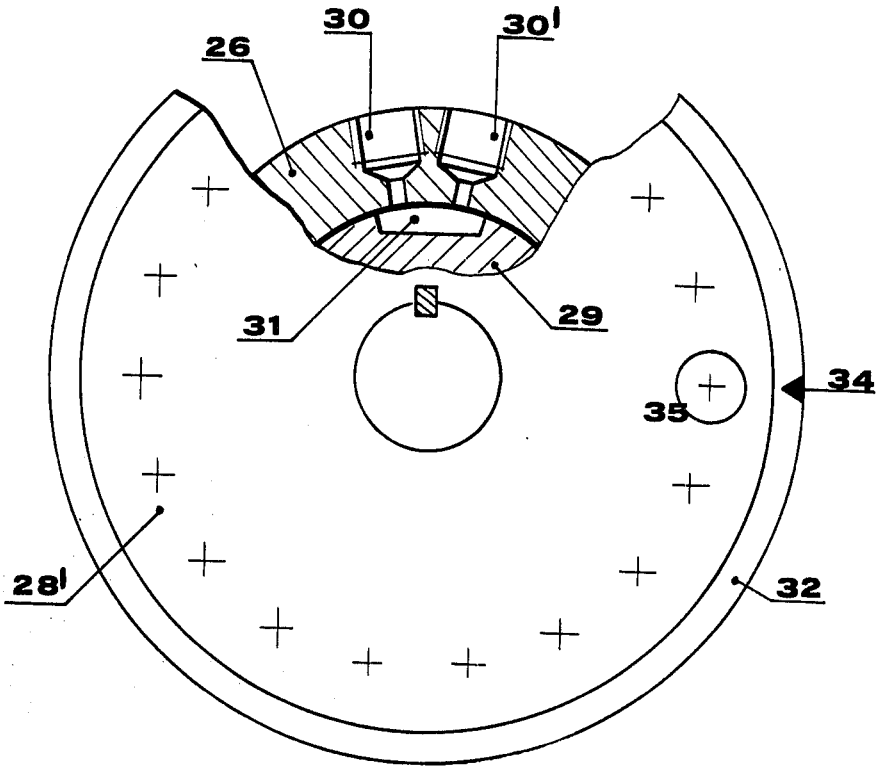
FIG. 12 shows a frontal partially sectioned view of the sleeve-like body of a combination device, fixed in the door and provided with inlet and outlet apertures for the liquid, and of the rotary knob provided at the inner side of the door.

FIG. 12 shows that the inlet and outlet holes 30, 30' of sleeve 26 may be connected with groove 31 of sleeve 29. This happens only in the case of a determined setting of said operational unity with a corresponding positioning of the rotary knob or member 28, 28'. Only in this position can the liquid passing through tube 2 flow through the respective combination device.

The combination device according to the present invention substantially comprises a central sleeve-like body 26 fixed inside the door and having a central, circular aperture 40 extending in a longitudinal direction along its central axis. Within this aperture is held a rotable shaft 27 whose two ends project towards the inside and the outside of the door. At each end of shaft 27 is mounted a rotary knob or disk-like member 28, 28' showing twenty-one different indicia (i.e., letters or numbers) in such a way that the positions of the same indicia on both rotary knobs or disk-like members 28, 28' are in correspondence. The adjustment of each combination device C1, C2, C3, C4 can be performed only from the inner side of the door.

On the transverse shaft 27 is seated a sleeve 29 which can freely rotate, said sleeve being affixed to a disk 32 whose diameter is slightly larger that the diameter of the rotary knob or disk-like member 28, 28'. Disk 32 has near its circumference a through hole 32', above which is borne a mark 34. The tightly interconnected sleeve 29 and disk 32 freely rotate about shaft 27.

On the inner rotary knob or disk-like member 28' are formed as many threaded holes as there are letters (or numbers). After selection of a desired letter (or number), a knurled-headed screw 35 is screwed into a corresponding taphole 52. The screw shaft is provided with threads only from its middle to the head of the screw. The rotary knob or member 28' is then turned until screw 35 comes into correspondence with the marking 34 provided on disk 32. Screw 35 is then screwed tightly so that its shaft is inserted into hole 32' in disk 32. The rotary knobs or members 28, 28', the shaft 27, the disk 32, and the sleeve 29 thus come into tight interconnection corresponding to the chosen letter.

In the outer portion of sleeve 29 a small groove 31 is provided in fixed relationship with the hole 32' provided in disk 32. In the outer wall of the fixed sleeve 26 of the combination device are provided two bores 30, 30' at a small distance from one another connecting the outer part of the sleeve with a central semicircular aperture containing the movable sleeve 29. One bore 30 allows the inlet of the liquid (or gas) into the central aperture of the combination device, and the other bore 30' allows the outlet of the liquid (or gas) from said aperture. The flow can take place only when groove 31 on the outer wall of sleeve 29 is set in perfect correspondence with the two bores 30, 30' in the central semicircular aperture of the fixed body 26 of the combination device. This in turn takes place only for a unique positioning of this device relating to a preset letter or number. For the setting of this position two corresponding markings 34" (e.g., see FIG. 2) are provided one facing the inside and the other the outside of the door, giving the position of the rotable part of the combination device necessary for flow.

After selection of the desired letter or number, and after the knurled-head screw 35 has been screwed in the tap hole 52 corresponding to this letter or number, the screw 35 is brought into a position corresponding to the hole 32' in disk 32 and fixed by tightly screwing into the tap hole; thus all of the mentioned elements obviously form a unity. When the chosen letter is then brought into correspondence with the marking 34" provided inside or outside of the door, by turning the respective inner or outer rotary knob or disk-like member 28, 28', flow through the corresponding combination device is allowed.

The same procedure applies to the other combination devices, so that after the setting of each according to the predetermined combination, actioning of the pump gear by the inner or outer handle M, M' of the door, the liquid (or gas) is put under pressure. Following the pressurization of the locking means, the door can be opened. In the case of four combination devices, $21^4 = 194{,}481$ letter or number combinations are possible.

To set up this pressure the manifold device D must be set in such a way that a hole 1' connected to tube 1 leading to reservoir S is blocked, so that no back flow towards said reservoir can occur. In connection with the described adjustment of the combination and manifold devices, it is sufficient to move either one of the two door handles M, M' two or three times upwards and downwards to build up the necessary pressure. The liquid under pressure is sent—as described in more detail hereinbelow—to the corresponding locking means.

To keep potential leaks in combination devices C1, C2, C3, C4, from causing movements of pistons 3''', 4''', 5''', 6''' out of cylinders 3'', 4'', 5'', 6'', a check valve V' is provided according to FIG. 3 between the manifold device D and the combination Device C4.

When tube 1 is blocked, the pistons could conceivably move slowly out of the cylinders because of a leak in one or more of the combination devices, so that it would become necessary to repeatedly perform the pumping action. To avoid this malfunction, the present invention provides the interconnection of a check valve V' between the manifold device D and the nearest combination device C4. By means of this check valve the maintenance of the liquid pressure is assured even in case of possible leaks in the combination devices.

FIG. 3 shows how a separate tube R' connects combination device C1 directly to reservoir S. Once the liquid pressure for the pushing back of the pistons into the irrespective cylinders has been built up, said tube R' allows the backflow of the liquid upstream of check valve V'.

In order to allow the liquid upstream of check valve V' to flow back into the reservoir S after the building up of pressure in the tubes 3, 4, 5, 6 leading from the manifold device D to the locking means 3'', 4'', 5'', 6'', according to the present invention, a backflow tube R' is provided preferably connecting the first combination device C1 nearest to the pump directly to the reservoir S. As mentioned before, the liquid pressure in the tubes leading from the manifold device D to the locking means is maintained by means of the check valve V'.

Finally, FIG. 3 shows a pressure relief valve V placed between pump P and combination device C1 and connected to reservoir S by means of a separate tube R. If excess pressure is built up in combination devices C1, C2, C3, C4, making the same more difficult to use and being even potentially damaging to the devices and/or the tubes, the pressure relief valve V would go into action, thus blocking tube 2 as long as the excess pressure is present, and the pumped liquid would flow back through tube R directly to reservoir S.

Furthermore, in case of repeated pumping action, an excess pressure could be generated in the combination devices. This excess pressure would make the work more difficult when setting each single letter combination by means of the rotary knobs and could cause damage to the combination devices as well as to the tubes. In order to avoid such malfunctions, the present invention provides for the interconnection of a pressure relief valve V placed between the pump P and the nearest combination device C1, and comprising a special tube R connecting the pressure relief valve V directly to the reservoir S. In case of excess pressure in the tubes 2 connecting the combination devices, the pressure relief valve V would block the flow towards these devices, and the liquid would flow back through the separate tube R to the reservoir S.

The functioning of the locking device according to the present invention is as follows:

If the door is locked or unlocked with a conventional lock with a key, all pistons 3''', 4''', 5''', 6''' remain in a completely retracted position within cylinders 3'', 4'', 5'', 6''. This means that the liquid in tubes 3, 4, 5, 6 (FIG. 3) has reached the necessary pressure to act against spring 17 (FIG. 8). Tube 1 is blocked by means of movable body D' of manifold device D, said body being in the position illustrated in FIG. 7, thus preventing backflow into reservoir S. The combination device connected to tube 2, wherein the liquid pressure has been built up by means of the pump gear operated by handles M, M', may be opened or closed, i.e., depending on whether the combination has been set or not, tube 2 may be open or closed to flow via bores 30, 30' (FIGS. 11 and 12).

If the door has to be unlocked by means of the combination-operated locking device according to the present invention, the four combination devices must be first prepared with their respective desired letters for the combinations. For this purpose four letters, one for each combination device, must be selected.

For example, let A, B, C, and D be the chosen letters to be prepared in this same sequence in the combination devices of FIG. 3. Screw 35 (FIG. 11) will be screwed into the taphole 42 of rotary knob 28' corresponding to letter A, and said rotary knob will in turn be rotated until screw 35 will get into correspondence with marking 34 provided at the circumference of disk 32. Now screw 35 will be tightened, so that the smooth part of the shaft 44 enters hole 32' of disk 32 and connects the same operably with rotary knob 28'. As both rotary knobs 28 and 28' are fixed to shaft 27, and the letters are provided on both knobs in opposite correspondence, the first letter A is positioned for an inside as well as for an outside actioning. As disk 32 is fixed to sleeve 29, disk 32, sleeve 29 and rotary knob 28, 28' fixed to shaft 27 are operably connected by the tightening of screw 35, i.e., by the positioning of the desired letter in such a way that groove 31 of sleeve 29 is correspondent with bores 30, 30' as indicated by the marking 34. To allow the flow through a combination device, groove 31 must be brought into correspondence with holes 30, 30' (FIG. 11). The relative position of the holes 30, 30' is indicated by a marking 34'' which can be seen from the inside as well as from the outside of door 42. It is therefore sufficient that one predetermined letter or number on one of the rotary knobs 28, 28' be correspondent with the respective inner or outer marking 34'' to allow the flow through the combination device. After proper setting of all the combination devices, the pumping can take place.

It is obvious that only with this setting of the four series-connected devices according to the example, i.e., the chosen letters A, B, C, and D, is a flow through tube 2 possible, whereby the liquid placed under pressure flows to manifold device D and from there through tubes 3, 4, 5, 6 to their respective locking means. The pistons 3''', 4''', 5''', 6''' are pushed by the liquid pressure against the spring 17 into their respective cylinders 3'', 4'', 5'', 6'', and the door becomes unlocked.

Obviously the adjustment of the combination may take place only from the inner side of the door. Before pumping, movable body D' of manifold device D must be brought to the position of FIG. 7, so that a backflow to the reservoir S will be prevented. From the inside, body D' can be pushed out, and from the outside, it can be pushed in. After the pump has been operated two or three times by means of one of the door handles M, M', sufficient pressure is generated for the pushing in of pistons 3''', 4''', 5''', 6'''.

If the door is to be locked, it is sufficient to bring movable body D' of manifold device D into the position of FIG. 6. The liquid (or gas) is thus free to return to reservoir S whereby the pressure is released and the pistons 3''', 4''', 5''', 6''' will be pushed out again by the action of springs 17.

The advantages achieved by means of the present invention are essentially that a hydraulically or pneumatically, that is, fluid actuated locking device is realized, operated by a combination taking up little space, said device not making use of any mechanical or expensive elements, and said device not being exposed to great wear. Furthermore, no key is necessary for the actioning of the device according to the present invention. Given the large number of possible combination settings, this device is more reliable than those mechanically operated locking devices known until now.

There will now be obvious to those skilled in the art many modifications or variations of the above-described embodiment which, however, will not depart from the scope of this invention if defined by the following claims.

I claim:

1. A fluid-actuated lock for locking and unlocking a door, comprising:

a source of fluid;

changeable combination means permitting the selection of a unique predetermined setting for controlling and allowing the passage of fluid from said source of fluid upon the positioning of said combination means to said predetermined setting, and preventing the passage of said fluid when said positioning does not correspond to said predetermined setting;

at least one locking device which keeps the door normally locked, unlocks the door upon application of fluid under pressure, and automatically locks the door upon release of pressure from said fluid;

tube means connecting said source of fluid with said combination means and said combination means to said locking device;

pumping means interposed between said source of fluid and said tube means for pumping fluid under pressure through said tube means to said combination means and from said combination means to said locking device to unlock the door; and a valved manifold means, connected between said source of fluid, said locking device and said combination means, for transferring fluid from said combination means to said locking device, said manifold means including valve means for controlling, including allowing and preventing, return of said fluid to said source of fluid;

said valved manifold means in conjunction with said combination means permitting the flow of said fluid to said locking device when the positioning of said combination means corresponds to said unique predetermined setting so as to actuate said locking device;

whereby when said valve means is in a closed position and said fluid is pressurized by said pumping means and the setting of said combination means allows passage of the pressurized fluid to said locking device, said locking device unlocks the door, and when said valve means is moved to an open position, the fluid in said locking device is depressurized and said locking device automatically locks the door;

wherein said pumping means comprises:

a fluid pump having a piston movable between a suction stroke and a compression stroke, a lever arm having a first end and a second end, said first end being connected to said piston, fixed means connected to said lever arm and about which said lever arm rotates, cam means connected to said second end of said lever arm, said cam means serving to rotate said lever about said fixed means and simultaneously to move said piston with said first end between said suction and compression strokes, said cam means being manually operated, and spring means connected to said lever arm between said cam means and said fixed means for compressing a spring during said suction stroke and releasing said spring during, and thereby reinforcing, said compression stroke.

2. A lock as claimed in claim 1, further including fluid reservoir means for said source of fluid, in fluid connection with said fluid pump, wherein a pressure relief valve is installed downstream of said pumping means and upstream of said combination means, said pressure relief valve being connected to said fluid reservoir means.

3. A lock as claimed in claim 2, further including backflow means for connecting said combination means to said reservoir means.

4. A fluid-actuated lock for locking and unlocking a door, comprising:

a source of fluid;

changeable combination means permitting the selection of a unique predetermined setting for controlling and allowing the passage of fluid from said source of fluid upon the positioning of said combination means to said predetermined setting, and preventing the passage of said fluid when said positioning does not correspond to said predetermined setting;

at least one locking device which keeps the door normally locked, unlocks the door upon application of fluid under pressure, and automatically locks the door upon release of pressure from said fluid;

tube means connecting said source of fluid with said combination means and said combination means to said locking device;

pumping means interposed between said source of fluid and said tube means for pumping fluid under pressure through said tube means to said combination means and from said combination means to said locking device to unlock the door; and a valve manifold means, connected between said source of fluid, said locking device and said combination means, for transferring fluid from said combination means to said locking device, said manifold means including valve means for controlling, including allowing and preventing, return of said fluid to said source of fluid;

said valved manifold means in conjunction with said combination means permitting the flow of said fluid to said locking device when the positioning of said combination means corresponds to said unique predetermined setting so as to actuate said locking device, whereby when said valve means is in a closed position and said fluid is pressurized by said pumping means and the setting of said combination means allows passage of the pressurized fluid to said locking device, said locking device unlocks the door, and when said valve means is moved to an open position, the fluid in said locking device is depressurized and said locking device automatically locks the door;

wherein said combination means comprises:

fixed means mounted in the door for receiving rotatable means and having adjacent fluid inlet and outlet means;

first rotatable means mounted in said fixed means and having opposed inside and outside disklike members bearing a plurality of indicia, said indicia on one member corresponding to said indicia on the other member, said inside member having a plurality of first aligning means corresponding to each of said indicia, said first rotatable means being rotatable between a first position and a plurality of positions corresponding to each of said indicia;

second rotatable means mounted in said fixed means and having groove means for joining said inlet and outlet means into fluid connection, and also having a disk axially mounted between said disklike members and adjacent to said inside disklike member, said disk having a second aligning means achieving alignment with said first aligning means, said second rotatable means being rotatable between said first position, wherein said groove means is in alignment with said inlet and outlet means, thus joining them in fluid connection, and a plurality of positions corresponding to each of said indicia, and joining means for joining said first and second aligning means and thus joining said first and second rotatable means into a unitary rotatable means, whereby when said second rotatable means is rotated from said first position to a position corresponding to one of said indicia, said inlet and outlet means go out of fluid connection; and when said first and second aligning means and said resulting unitary rotatable means is rotated back to said first position, said inlet and outlet means come into fluid connection.

5. A lock as claimed in claim 4 comprising a plurality of said combination means.

6. A fluid-actuated lock for locking and unlocking a door, comprising:

a source of fluid;

changeable combination means permitting the selection of a unique predetermined setting for controlling and allowing the passage of fluid from said source of fluid upon the positioning of said combination means to said predetermined setting, and preventing the passage of said fluid when said positioning does not correspond to said predetermined setting;

at least one locking device which keeps the door normally locked, unlocks the door upon application of fluid under pressure, and automatically locks the door upon release of pressure from said fluid;

tube means connecting said source of fluid with said combination means and said combination means to said locking device;

pumping means interposed between said source of fluid and said tube means for pumping fluid under pressure through said tube means to said combination means and from said combination means to said locking device to unlock the door; and a valved manifold means, connected between said source of fluid, said locking device and said combination means, for transferring fluid from said combination means to said locking device, said manifold means including valve means for controlling, including allowing and preventing, return of said fluid to said source of fluid;

said valved manifold means in conjunction with said combination means permitting the flow of said fluid to said locking device when the positioning of said combination means corresponds to said unique predetermined setting so as to actuate said locking device, whereby when said valve means is in a closed position and said fluid is pressurized by said pumping means and the setting of said combination means allows passage of the pressurized fluid to said locking device, said locking device unlocks the door, and when said valve means is moved to an open position, the fluid in said locking device is depressurized and said locking device automatically locks the door;

wherein said locking means includes a plurality of said automatic locking devices, and further including a plurality of tube means connected to said plurality of locking devices and to said manifold means, and wherein said manifold means comprises:

a sleeve fixed in said door, said sleeve having a first hole connected to said source of fluid, a second hole connected to said tube means from said combination means, and a plurality of holes connected to said plurality of tube means to said plurality of locking devices;

a body slidingly mounted in said sleeve and having a groove means, said body having a first position wherein said groove is aligned with said first, second, and plurality of holes allowing free passage of fluid between them, and having a second position wherein said groove means is aligned with said second hole and said plurality of holes allowing free passage of fluid between them and wherein said first hole is blocked and fluid passage to said first hole is prevented, whereby when said body is in the second position and said fluid is pressurized, the pressurized fluid unlocks the locking means and when said body is moved to the first position and the first hole is unblocked, the locking means are depressurized and the automatic locking device operates to lock said locking means.

* * * * *